US006829901B2

(12) United States Patent
Harley et al.

(10) Patent No.: US 6,829,901 B2
(45) Date of Patent: Dec. 14, 2004

(54) SINGLE POINT MOORING REGASIFICATION TOWER

(75) Inventors: Richard B. Harley, The Woodlands, TX (US); E. Lawrence Kimble, Sugar Land, TX (US); Ronald R. Bowen, Magnolia, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/315,647

(22) Filed: Dec. 10, 2002

(65) Prior Publication Data

US 2003/0136132 A1 Jul. 24, 2003

Related U.S. Application Data

(60) Provisional application No. 60/340,920, filed on Dec. 12, 2001.

(51) Int. Cl.[7] ..... F17C 13/08; F17C 9/02; B63B 21/00; B63B 22/02

(52) U.S. Cl. ..... 62/53.2; 62/50.2; 114/230.15; 441/5

(58) Field of Search ..... 62/50.2, 53.2; 48/190; 114/230.1, 230.15; 441/5

(56) References Cited

U.S. PATENT DOCUMENTS

| | | | | |
|---|---|---|---|---|
| 2,940,268 A | * | 6/1960 | Morrison | 62/7 |
| 3,590,407 A | | 7/1971 | Bratianu et al. | 9/8 |
| 3,766,583 A | | 10/1973 | Phelps | 9/8 P |
| 4,273,066 A | | 6/1981 | Anderson | 114/256 |
| 4,494,475 A | | 1/1985 | Eriksen | 114/230 |
| 4,501,525 A | | 2/1985 | Grundy et al. | 414/139 |
| 4,669,412 A | * | 6/1987 | Pollack | 114/230.14 |
| 4,786,266 A | * | 11/1988 | Fozard et al. | 441/5 |
| 4,841,895 A | | 6/1989 | Brewerton | 114/230 |
| 6,085,528 A | * | 7/2000 | Woodall et al. | 62/45.1 |
| 6,089,022 A | | 7/2000 | Zednik et al. | 60/641.7 |
| 6,298,671 B1 | * | 10/2001 | Kennelley et al. | 62/50.2 |
| 6,517,286 B1 | * | 2/2003 | Latchem | 405/53 |
| 6,546,739 B2 | * | 4/2003 | Frimm et al. | 62/50.2 |

FOREIGN PATENT DOCUMENTS

| | | |
|---|---|---|
| DE | 32 00 958 | 7/1983 |
| WO | WO 86/07326 | 12/1986 |

OTHER PUBLICATIONS

Perkins et al., "Method and Apparatus for Delivering Natural Gas to Remote Locations", U.S. Patent Application Publication 2002/0073619, published Jun. 20, 2002, 6 pages.

R. Zubiate et al., "Single point mooring system for floating LNG plant", *Ocean Industry*, Nov., 1978, pp. 75, 77, and 78.

International Preliminary Examination Report, dated Feb. 24, 2004 to corresponding PCT Application No. PCT/US02/39659, filed Dec. 11, 2002.

* cited by examiner

*Primary Examiner*—William C. Doerrler

(57) ABSTRACT

Offshore facilities and methods are provided to enable the mooring of a ship carrying a liquefied gas to an offshore structure with one or more decks upon which are located (i) regasification facilities; (ii) single point mooring means for mooring a ship that is carrying a liquefied gas; (iii) means for offloading said liquefied gas into said regasification facilities; and (iv) means for transferring gas from said regasification facilities to a gas transport pipeline.

16 Claims, 1 Drawing Sheet

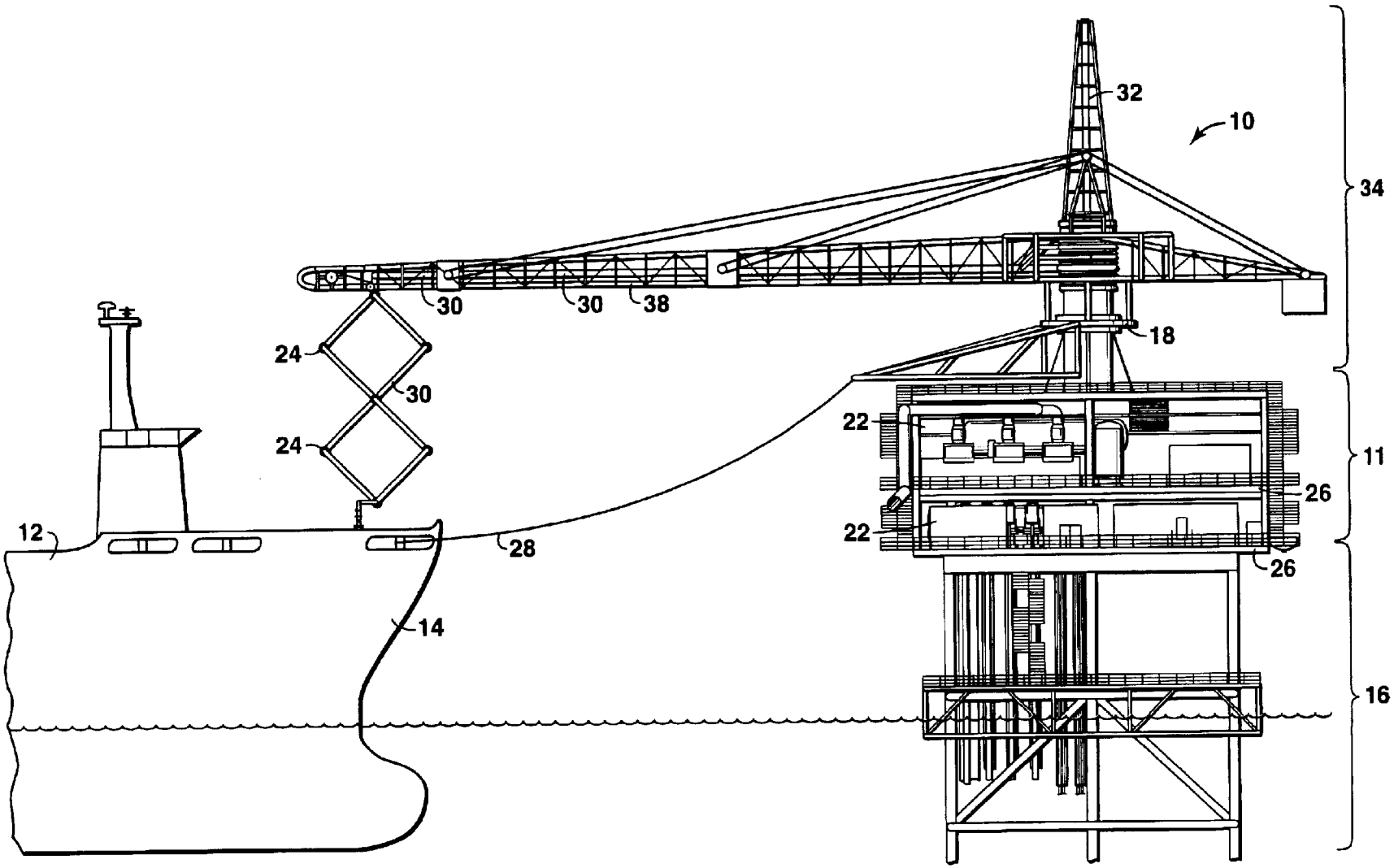
34
11
16
10
32
18
26
26
22
22
38
30
30
30
28
14
24
24
12

SINGLE POINT MOORING REGASIFICATION TOWER

This application claims the benefit of U.S. Provisional Application No. 60/340,920, filed Dec. 12, 2001.

FIELD OF THE INVENTION

This invention relates to improved systems and methods for transferring fluids from marine transportation vessels to end users. More specifically, the improvement relates to offshore structures including a single point mooring, regasification facilities, and means for unloading liquefied gases from marine transportation vessels into the regasification facilities. Advantageously, at an offshore structure or tower of this invention, liquefied gas is efficiently regasified for pipeline transport to end users while mooring forces on the marine transportation vessel are minimized.

BACKGROUND OF THE INVENTION

Various terms are defined in the following specification. For convenience, a Glossary of terms is provided herein, immediately preceding the claims.

Marine transportation vessels are frequently used for transporting fluids such as liquefied natural gas ("LNG"), i.e., natural gas that has been liquefied at substantially atmospheric pressure and a temperature of about −162° C. (−260° F.). U.S. Pat. No. 6,085,528 (the "PLNG Patent"), having corresponding International Publication Number WO 98/59085 and entitled "System for Processing, Storing, and Transporting Liquefied Natural Gas", and U.S. Pat. No. 6,460,721 (the "Composite Container Patent"), having corresponding International Publication Number WO 00/57102 and entitled "Improved Systems and Methods for Producing and Storing Pressurized Liquefied Natural Gas", both describe containers and transportation vessels for storage and marine transportation of pressurized liquefied natural gas (PLNG) at a pressure in the broad range of about 1035 kPa (150 psia) to about 7590 kPa (1100 psia) and at a temperature in the broad range of about −123° C. (−190° F.) to about −62° C. (−80° F.). The PLNG Patent and the Composite Container Patent are hereby incorporated herein by reference.

Offloading of PLNG from a marine transportation vessel at import terminals would likely be accomplished with natural gas. It is expected that loading and unloading of PLNG using such a process would be relatively slow and would require that the marine transportation vessel be berthed at the terminal for a period of days, depending on the PLNG cargo capacity of the marine transportation vessel.

Since PLNG is an emerging technology, commercial import terminals for PLNG are not available. However, in most cases where there is a need for single point mooring of ships with process facilities nearby, as is the case with PLNG, the facilities have been installed on a separate platform or on a floating hull to which the ship is then moored in tandem. These are the usual solutions because they are often in deepwater where a tall tower with a large horizontal mooring load would combine to produce a very high overturning moment and require a very costly structure. However, import terminals are not always in deep water. In shallow water, a different scenario arises. The offshore mooring structure, such as a single point mooring tower, is often close enough to shore whereby a subsea pipeline connected to an onshore process facility is typically a good economic means for processing fluids unloaded from a ship. However some fluids do not lend themselves to subsea pipeline transport. This is particularly the case with very cold or cryogenic fluids, for which subsea pipeline designs are still being developed, and will themselves be quite costly.

Some designs have been proposed to solve the aforementioned deepwater and shallow water problems by installing regasification process facilities on each of a set of specially built ships (e.g., U.S. Pat. No. 6,089,022, entitled "Regasification of Liquefied Natural Gas (LNG) Aboard A Transport Vessel"). This design could allow delivery of gas from the transportation vessel to a subsea pipeline for long distance transmission, but a set of regasification facilities is required on each transportation vessel or ship. Regasification facilities onboard each ship would require ship modifications and add to the cost of both facilities and ships. Additionally, high pressure subsea hoses that can be easily connected/disconnected from standard tankers have not yet been devised. Therefore, a tanker with onboard regasification facilities cannot discharge directly to a subsea line through hoses or even a floating buoy system. An offshore structure is still required. Some shipping companies have proposed discharge of gas through submerged turrets connected into the bottom of the ship's hull (avoiding the need for an offshore structure); but turret arrangements require expensive modifications to the ship's hull. It is desirable to have a system for cost effective delivery of a liquefied gas, such as pressurized liquefied natural gas, from a transport vessel to a subsea pipeline in gaseous form.

Therefore, an object of this invention is to provide cost effective offshore facilities for offloading liquefied gases into pressurized gas transmission lines. Other objects of this invention will be made apparent by the following description of the invention.

SUMMARY OF THE INVENTION

Consistent with the above-stated objects of the present invention, an offshore facility is provided that comprises one or more decks upon which are located: (a) regasification facilities; (b) single point mooring means for mooring a ship that is carrying a liquefied gas; (c) means for offloading said liquefied gas into said regasification facilities; and (d) means for transferring gas from said regasification facilities to a gas transport pipeline.

DESCRIPTION OF THE DRAWINGS

The advantages of the present invention will be better understood by referring to the following detailed description and the attached drawing in which:

FIG. 1 illustrates an offshore structure according to this invention.

While the invention will be described in connection with its preferred embodiments, it will be understood that the invention is not limited thereto. On the contrary, the invention is intended to cover all alternatives, modifications, and equivalents which may be included within the spirit and scope of the present disclosure, as defined by the appended claims.

DETAILED DESCRIPTION OF THE INVENTION

The offshore structure of this invention is particularly advantageous for loading and/or offloading liquids from tankers in situations where it is desirable to have process facilities immediately adjacent to the loading/unloading connection due to a need to avoid pressure drop during fluid transfer, or to minimize piping cost, or to overcome physical limitations, or for other reasons, as will be familiar to those skilled in the art. As used herein, the terms "tanker", "ship", "transport vessel", and "marine transportation vessel" are interchangeable.

Referring now to FIG. 1, an offshore structure 10 of this invention is illustrated. Offshore structure 10 comprises a base 16 and topsides 11. A ship 12 can moor directly to the offshore structure 10 of this invention by a single point connection between the ship's bow 14 and the offshore structure 10. On offshore structure 10, swivel(s) 18 rotate(s) so that the cargo transfer connection 30 aligns with bow 14 of ship 12. As a result ship 12 can revolve around offshore structure 10 (like a weathervane) to minimize the environmental forces (and hence mooring forces) acting on offshore structure 10. Wind, wave, and current forces affecting ship 12 are minimized because the resultant of these forces acts upon the narrowest exposure of ship 12, i.e., upon bow 14 of ship 12. Process equipment 22, including for example regasification equipment, is located on offshore structure 10 below rotating fluid swivel(s) 18, so that process equipment 22 does not rotate and can be founded on one or more fixed decks 26. Offshore structure 10 of this invention provides a unique arrangement of mooring, cargo transfer, and process equipment that enables higher performance loading and/or unloading at potentially much lower cost as compared to traditional systems. Performance is enhanced by the capability to add booster pumps, compressors, vaporizers, or other process facilities immediately adjacent to a ship, such as ship 12, even in an offshore setting that requires a single point mooring to maintain a high level of berth availability. While most recent single point mooring designs are composed of buoys or other floating structures that allow the ship to weathervane around the mooring, thus facing into the winds, waves, and currents and minimizing forces, motions, and downtime, offshore structure 10 of this invention resurrects the original early designs of single point moorings, founded on fixed structures. However, it also utilizes the longer reaching cargo transfer booms, e.g., boom or arm 38, recently designed by offshore system vendors. In this invention, this allows transfer of cold liquids to the platform structure or topsides 11, where regasification equipment 22 has been incorporated, thus allowing low cost transfer of gas into a transmission pipeline network (not shown in FIG. 1). Means for transferring gas from the regasification equipment 22 to a gas transport pipeline, via a riser for example, are well known to those skilled in the art.

Rotating swivel(s) 18, located above process equipment 22, and rotating swivel connections 24 in cargo transfer connection 30 preferably accommodate the rotation of both the mooring connection 28 and the cargo transfer connection 30 between bow 14 of ship 12 and offshore structure 10. Preferably, boom/arm 38, mooring connection 28, and cargo transfer connection 30 rotate together as an integrated unit. Cargo transfer connection 30 may be any of a variety of available fluid carrying conduits, as will be familiar to those skilled in the art, arranged in such a way to reach from offshore structure 10 to bow 14 of ship 12 and to accommodate the relative motions therebetween (six degrees of freedom). As will be familiar to those skilled in the art, the conduit 30 may be hose, flexible pipe, articulated pipe, or any other fluid carrying system which will generally reach over to bow 14 with the help of some crane, bridge, long beam (separate or integrated), or similar device, such as arm 38.

Central vertical axis 32 preferably includes rotating structural assemblies 34 sufficiently reinforced and supported to carry mooring loads to offshore structure 10. Central vertical axis 32 also preferably includes one or more fluid swivels 18, arranged to rotate concentrically with themselves and the mooring connection 28, that will provide for multiple fluid flow paths from the stationary offshore structure 10 to the moving ship 12 at any position around offshore structure 10.

The offshore structure 10 of this invention may be designed as any of the available or potential structural concepts for offshore platforms. A steel-framed jacket, a steel caisson, a concrete GBS, or a concrete caisson are all examples of candidate structural concepts for base 16. Topsides 11 will be a relatively small platform, compared to typical offshore facilities, since the regasification process needs much less space than typical production units. Therefore, the length of the arm 38 required to reach to the ship 12 from the rotating structural assemblies 34, at the central vertical axis 32 of offshore structure 10 can be quite reasonable. In addition, if a large platform were required for some other reason, then a separate single point mooring would probably be built to avoid the complexity and compounding of design issues that would be associated with combining the two.

As mentioned in describing the background of the invention, an offshore mooring structure, such as a single point mooring tower, in shallow water is often close enough to shore whereby a subsea pipeline connected to an onshore process facility is typically a good economic means for processing fluids unloaded from a ship. However some fluids do not lend themselves to subsea pipeline transport. This is particularly the case with very cold or cryogenic fluids, for which subsea pipeline designs are still being developed, and will themselves be quite costly. The offshore structure 10 of this invention offers a solution to this problem whereby the process facilities on the offshore structure 10 enable transport of gas through the subsea lines by first converting it from a pressurized and/or cryogenic liquid to a gaseous state.

Some of those skilled in the art may initially think that maneuvering a large ship close to a structure such as the offshore structure 10 of this invention presents an unnecessary risk. However, large spar buoys and caissons are often used for tanker loading or unloading. The offshore structure of this invention is no more susceptible to damage than large spar buoys and caissons, and they are just as valuable as well. Nevertheless, bow thrusters, tug assistance, and fendering on the structure can all be considered if additional assurance is considered necessary.

The offshore transport of liquefied gas at cold temperature can be accomplished at less cost and with more conventional equipment if the offshore structure of this invention is used, as compared to typical harbor facilities now most common for such transport, or gravity based concrete terminals built offshore with storage, or concepts with regasification facilities on the ships (either with their own platforms or submerged turret loading). In particular, the regasification of liquefied gas can be easily accomplished on a reasonably sized tower structure. Also, the expense of placing regasification facilities onboard each ship is avoided. For a case involving PLNG, less than 5000 tonnes and 120 ft. square of deck (using two decks) may be suitable. Conventional LNG may even require less deck space. Transport of LNG to shore without such facilities would at least be more costly, if not impossible, because of the problems associated with the design of subsea cryogenic pipelines.

Although this invention is well suited for unloading and processing of PLNG, it is not limited thereto; rather, this invention is suitable for unloading and processing of other fluids, including without limitation cryogenic fluids such as LNG. Additionally, while the present invention has been described in terms of one or more preferred embodiments, it is to be understood that other modifications may be made without departing from the scope of the invention, which is set forth in the claims below.

Glossary of Terms

Composite Container Patent: U.S. Pat. No. 6,460,721;

cryogenic temperature: any temperature of about −40° C. (−40° F.) and lower;

LNG: liquefied natural gas at substantially atmospheric pressure and about −162° C. (−260° F.);

PLNG: pressurized liquefied natural gas at a pressure in the broad range of about 1035 kPa (150 psia) to about 7590 kPa (1100 psia) and at a temperature in the broad range of about −123° C. (−190° F.) to about −62° C. (−80° F.);

PLNG Patent: U.S. Pat. No. 6,085,528.

We claim:

1. An offshore facility comprising one or more decks upon which are located:

(a) regasification facilities;

(b) single point mooring means for mooring a ship that is carrying a liquefied gas;

(c) means for off loading said liquefied gas into said regasification facilities; and (d) means for transferring gas from said regasification facilities to a gas transport pipeline, whereby said single point mooring means and said means for offloading said liquefied natural gas are adapted to rotate between said ship and said offshore facility.

2. A method comprising:

(a) mooring a ship carrying a liquefied gas to an offshore facility comprising one or more decks upon which are located (i) regasification facilities; (ii) single point mooring means for mooring a ship that is carrying a liquefied gas; (iii) means for offloading said liquefied gas into said regasification facilities; and (iv) means for transferring gas from said regasification facilities to a gas transport pipeline, whereby said single point mooring means and said means for offloading said liquefied natural gas are adapted to rotate between said ship and amid offshore facility;

(b) offloading said liquefied gas Into said regasification facility; and (c) transferring gas from said regasification facilities to said gas transport pipeline.

3. An offshore facility comprising one or more decks upon which are located:

(a) regasification facilities;

(b) a single point mooring connection for mooring a ship that is carrying a liquefied gas; and (c) a cargo transfer connection including a fluid carrying conduit for offloading said liquefied gas into said regasification facilities, whereby said single point mooring connection and said cargo transfer connection are adapted to rotate between said ship and said offshore facility.

4. An offshore facility according to claim 3, further comprising:

(d) a device selected from the group consisting of a riser and a subsea line for transferring gas from said regasification facilities.

5. An offshore facility according to claim 4, wherein said device for transferring gas transfers gas from said regasification facilities to a gas transport pipeline.

6. An offshore facility according to claim 4, wherein said fluid carrying conduit is selected from a hose, a flexible pipe, an articulated pipe or combinations thereof.

7. An offshore facility according to claim 4, wherein said cargo transfer connection includes a rotating swivel connection.

8. An offshore facility according to claim 7, wherein said cargo transfer connection includes a plurality of rotating swivel connections.

9. An offshore facility according to claim 4, wherein said fluid carrying conduit is carried on a boom.

10. An offshore facility according to claim 9, wherein said boom is carried on a rotating structural assembly.

11. An offshore facility according to claim 10, wherein said conduit includes a fluid swivel located on said offshore facility.

12. An offshore facility according to claim 11, wherein said single point mooring connection is yarned on said rotating structural assembly, thereby accommodating the rotation of both said single point mooring connection and said cargo transfer connection.

13. An offshore facility according to claim 4, wherein said offshore facility is comprised of a topside and a base, said base selected from the group consisting of a stool-framed Jacket, a steel caisson, a concrete GBS and a concrete caisson.

14. A method comprising:

(a) mooring a ship carrying a liquefied gas to an offshore facility comprising one or more decks upon which are located (i) regasification facilities; (ii) a single point mooring connection for mooring a ship that is carrying a liquefied gas; and (iii) a cargo transfer connection for offloading said liquefied gas into said regasification facilities, whereby Said single point mooring connection and said cargo transfer connection are adapted to rotate between said ship and said offshore facility;

(b) offloading said liquefied gas into said regasification facility; and (c) transferring gas from said regasification facility.

15. A method according to claim 14, wherein said mooring step (a) includes mooring said ship to said offshore facility, said offshore facility further comprising:

(iv) a device selected from the group consisting of a riser and a subsea line for transferring gas from said regasification facilities.

16. A method according to claim 15, wherein said transferring step (c) includes transferring gas from said regasification facility to a gas transport pipeline.

* * * * *